United States Patent [19]

Johnson et al.

[11] 4,098,481

[45] Jul. 4, 1978

[54] TRACK ASSEMBLY

[75] Inventors: Thomas O. Johnson; Charles J. Slayman, both of Louisville, Ky.

[73] Assignee: General Electric Company, Louisville, Ky.

[21] Appl. No.: 795,062

[22] Filed: May 9, 1977

[51] Int. Cl.[2] ..... A47B 9/00

[52] U.S. Cl. ..... 248/243; 108/108; 211/90

[58] Field of Search ..... 248/243, 244, 245, 246; 211/90, 87; 108/107, 108, 110; 52/36

[56] References Cited

U.S. PATENT DOCUMENTS

| | | | |
|---|---|---|---|
| 806,677 | 12/1905 | Keil | 248/243 |
| 3,158,113 | 11/1964 | Johnson | 211/90 X |
| 3,352,428 | 11/1967 | Sak et al. | 248/246 X |
| 3,993,002 | 11/1976 | Stroh | 108/108 |

FOREIGN PATENT DOCUMENTS

| | | | |
|---|---|---|---|
| 214,099 | 8/1960 | Austria | 248/243 |
| 136,435 | 7/1952 | Norway | 211/90 |

*Primary Examiner*—J. Franklin Foss
*Attorney, Agent, or Firm*—Frederick P. Weidner; Francis H. Boos

[57] ABSTRACT

A track assembly for securing to a wall and receiving shelves. The track assembly includes two spaced, parallel, elongated strips having a plurality of slots along their lengths. There is also provided an adapter member located at one end of each of these strips and the adapter member is U-shaped to provide depending legs connected by a body with the body having at least one circular hole therethrough and dimensioned for each of the legs to be received through the slots in the strips such that the circular hole overlies one of the slots. There is also a headed attachment element through the circular hole of each of the adapter and the underlying strip slot into the wall to secure each of the strips to the wall. Shelf brackets are provided for each of the strips with the brackets having a hook-shaped attachment element at one end removably inserted in the slots for support of the bracket.

10 Claims, 2 Drawing Figures

TRACK ASSEMBLY

BACKGROUND OF THE INVENTION

1. Field of the Invention

The present invention relates to a track assembly and more particularly to a cantilever track assembly for use in refrigerators.

2. Description of the Prior Art

In utilizing adjustable track assemblies it is desirable in most cases to employ different lengths of track. For instance in household refrigerators it is desirable to provide vertically adjustable shelves so that the interior configuration of a refrigerator may be arranged to accommodate different sizes of food at different times. Refrigerators, however, vary in size and particularly the vertical lengths of the interior of the refrigerator will vary thus requiring that the length of the track for the shelves also vary accordingly. It is desirable to provide a track assembly so that the brackets which hold the shelves may be arranged for easy removal and adjustment but are secured in place so that they will not inadvertently become disengaged and fall out.

Generally the track assembly includes two spaced parallel vertical elongated strips having a plurality of slots along their lengths. Each of these strips are secured to the interior of the refrigerator by headed screws at least at each end of the strips. To provide for such securement the strips have circular holes to receive the threaded portion of the screws which pass through the circular holes in the strip and are secured to the liner of the refrigerator. In the process of manufacturing the track assembly a punch press may be employed having dies that will form in the strip a circular hole at both ends of the strip to receive the fastening screws and spaced slots between the ends thereof to receive cantilever brackets. Should a different length of strip be required depending upon the size of the interior of the refrigerator into which it is installed then the punch press must have the dies changed so that the circular holes and slots are provided for the different lengths of strip. This, of course, requires punch press down time in order for the operator to make the necessary die changes and it also is an expensive method of manufacturing the slotted strip as each length of strip requires a different set of dies.

By the present invention, there is provided a low cost means to manufacture such track assemblies wherein various lengths of strip may be formed on one set of punch press dies.

SUMMARY OF THE INVENTION

In accordance with the present invention, there is provided a track assembly for securing to a wall and receiving shelves. The track assembly includes two spaced, parallel, elongated strips having a plurality of slots along their lengths. There is provided an adaptor member located at one end of each of the strips and the adaptor member is U-shaped as viewed in cross section along its longitudinal axis to provide depending legs connected by a body. The body has at least one circular hole therethrough and is also dimensioned for each of the legs to be received through the slots in the strips such that the circular hole overlies one of the slots. A headed attachment element through the circular hole of each of the adapters and underlying strip slot secures the strips to the wall. Shelf brackets for each of the strips are provided and have a hook-shaped attachment means at one end removably inserted in the slots of the strip for support of the bracket.

DESCRIPTION OF THE PREFERRED EMBODIMENT

Figure 1:
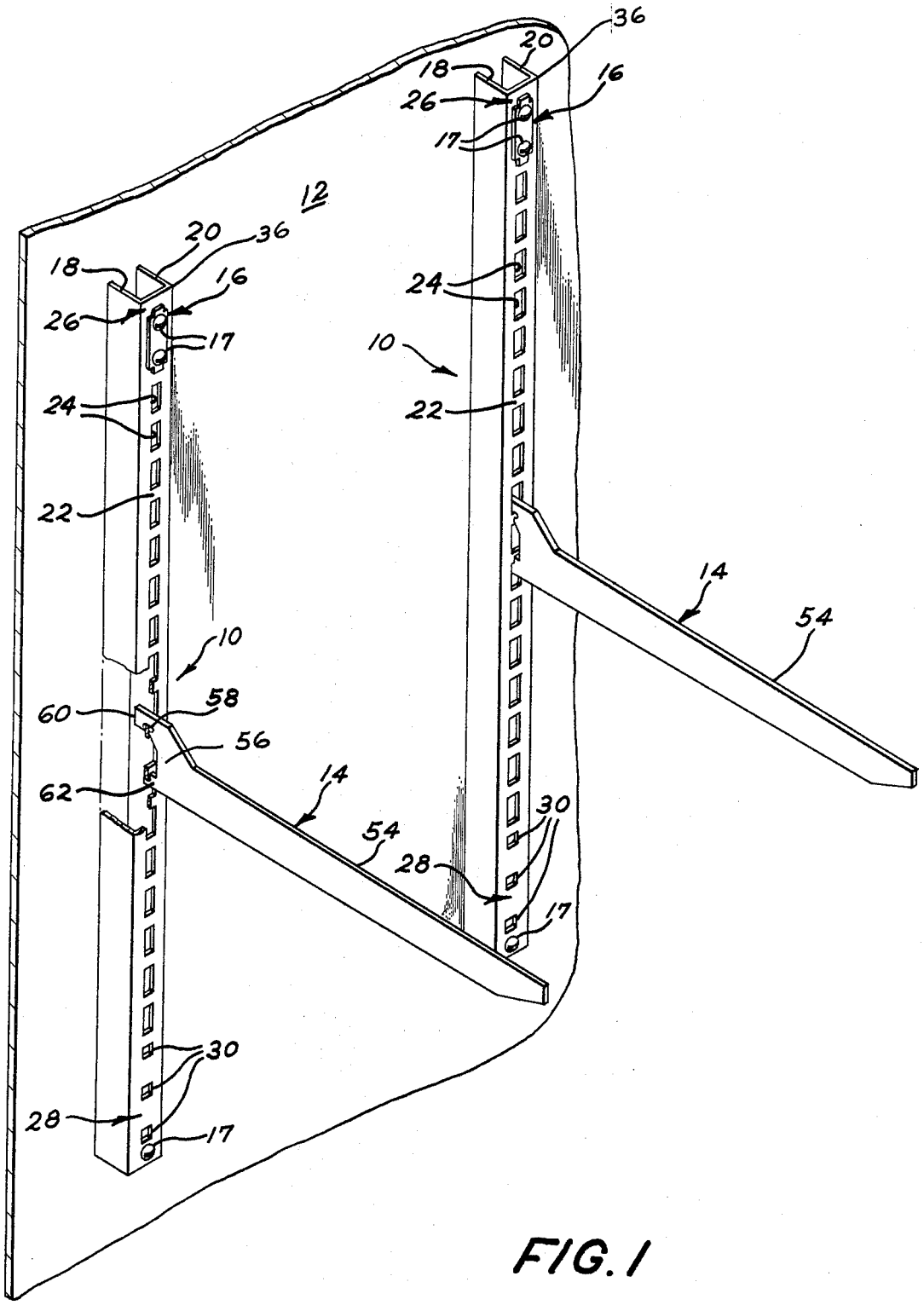
FIG. 1 is a perspective view of the track assembly of the present invention.

Referring to FIG. 1, there is shown the track assembly of the present invention. The track assembly includes two spaced parallel elongated strips 10 secured to a wall 12 which, in the case of one embodiment, is the interior liner of a refrigerator. The track assembly also includes shelf brackets 14, an adaptor member 16, and headed attachment elements or screws 17. Since the elongated strips 10, shelf brackets 14, adaptor member 16, and screws 17 are identical but spaced from each other to support a shelf therebetween resting on the shelf brackets 14, a detailed description of only one set of such components is necessary. Elongated strip 10 is U-shaped as viewed in lateral cross-section and includes two legs 18 and 20 and a connecting middle portion 22 with the free ends of the legs 18 and 20 abutting the wall 12. The middle portion 22 has a plurality of rectangular slots 24 that run from the top portion 26 of the elongated strip 10 toward the bottom portion 28 of the elongated strip. In the bottom portion 28 of the strip 10 there are one or more smaller diameter slots 30, the purpose of which will be described later.

Figure 2:
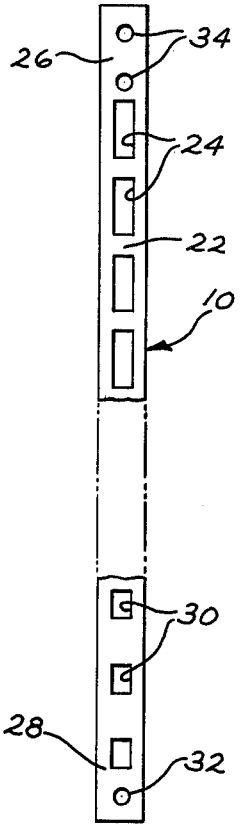
FIG. 2 PRIOR ART
FIG. 2 is a vertical plan view of the strip portion of a prior art track assembly.

In the prior art track assembly shown in FIG. 2 the elongated strip 10 was fastened to the wall 12 by a headed screw that passed through a circular hole 32 in the bottom portion 28 of the strip 10 and threaded screws through the two circular holes 34 located in the top portion 26 of the strip 10. Two screws were used at the top of the strip to provide adequate strength of securement. It will be understood that if the length of the strip 10 was to be varied for whatever reason then the punch press dies required to form the respective circular holes 32, 34 and the slots 24 and 30 in the strip would have to be changed. By this invention the time consuming change of dies and the cost of providing the various necessary dies to accommodate the different lengths of strip may be avoided.

Figure 3:
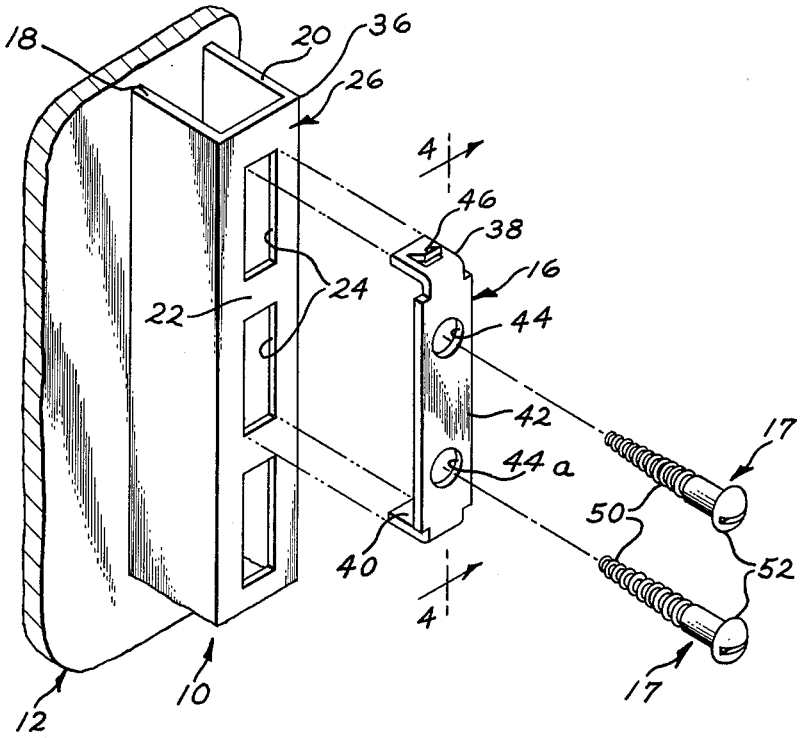
FIG. 3 is an exploded perspective view of the track assembly of the present invention.
Figure 4:
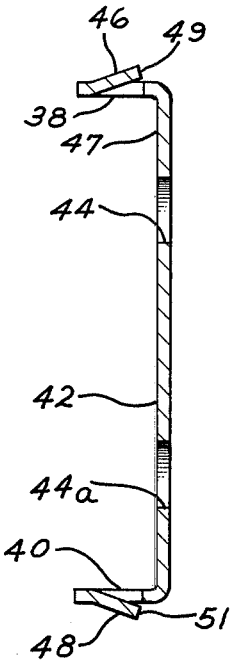
FIG. 4 is a cross-section taken along lines 4—4 of FIG. 3.

With particular references to FIGS. 1, 3 and 4, the track assembly of the present invention will be further described. The elongated strip 10, as shown in FIG. 3, has at the top portion 26 thereof no circular holes but rather slots 24. Therefore, in manufacturing the strip 10 only circular hole 32 in the bottom portion 28 will be in the strip 10. The punch press dies would only then require that the dies accommodate the longest contemplated strip 10 that would be used in making the various track assemblies. Upon closing of the punch press the circular hole 32 would be formed along with the slots 30, and the rectangular slots 24 from the middle portion 22 through the upper portion 26 to the end 36 of the strip 10.

To provide for fastening the top portion 26 to the wall 12 there is provided adaptor member 16. The adaptor member 16 is U-shaped as viewed in cross-section along its longitudinal axis and has depending legs 38 and 40 connected by a body 42. The body 42 has at least one circular hole 44 therethrough and preferably also a second circular hole 44*a* spaced from circular hole 44. The longitudinal dimension or length of the adaptor member 16 is such that both depending legs 38 and 40 will be received through slots 24 in the strip 10 and each of the circular holes 44 and 44*a* overlies one of the slots 24. In the case of the preferred embodiment wherein the adaptor member 16 has two circular holes 44 and 44*a* in the body 42, leg 38 is received in one rectangular slot 24 with the upper circular hole 44 overlying that same slot and the leg 40 is received in an adjacent slot 24 with the hole 44*a* overlying that slot. The legs 38 and 40 may, of course, be received in slots such that the circular holes 44 and 44*a*, in the case where two holes are employed, may overlie other slots. This will depend upon the length of body 42 relative to the spacing of slots 24. The legs 38 and 40 preferably have a tang 46 in leg 38 and a tang 48 in leg 40. These tangs may be formed in any convenient way and in the case of the preferred embodiment the legs 38 and 40 are lanced and the tangs formed by the material being bent or displaced outwardly of the leg. The adaptor member 16 is dimensioned relative to the slots 24 so that when the legs 38 and 40 are inserted through the slots 24 the tangs 46 and 48 cooperate with the end edges of the slots to force the legs 38 and 40 inwardly toward each other and when the surface 47 of body 42 of the adaptor 16 abuts the strip 10 the legs 38 and 40 will spring outwardly away from each other to thus retain the adaptor member 16 in its proper location. To accomplish this the distance between the adaptor body 42 surface 47 abutting the strip 10 and the ends 49 and 51 of the tangs 46 and 48 respectively is slightly greater, than the thickness of strip portion 22 having the slots 24.

To complete securing the track assembly to the wall 12 headed attachment elements 17 having a body 50 and a headed portion 52 larger than the holes 44 and 44*a* are placed through the circular holes 44 and 44*a* with the head 52 abutting the body 42 of the adaptor member 16. The body 50 of the elements 17 will pass through the slots 24 and engage the wall 12. Similarly the bottom portion 28 of the strip 10 is secured to the wall 12 by a headed attachment element 17 passing through circular hole 32 into the wall 12. Preferably the headed attachment elements 17 are screws with the body 50 threaded.

For placing shelves between the spaced strips 10 there are provided brackets 14 which are movable vertically along the strip 10. The brackets 14 are cantilevered and include a shelf supporting arm 54 which has at one end thereof a strip securing portion 56. The strip securing portion 56 includes an upper hook-shaped attachment means or element 58 which is removably inserted in the slots 24. For this purpose the end 60 of the hook shaped element 58 is dimensioned to be slightly smaller than the slots 24 so that it may be received therethrough. The end 60, however, is larger than the dimensions of the smaller slots 30 in the bottom portion 28 of the strip 10 so that it cannot pass through those slots. Also, on the strip securing portion 56 of the bracket 14 and located below the hook-shaped element 58 is a tab 62 which is dimensioned to be removably inserted in all of the slots including slots 24 and 30 of the strip 10. That is, the tab is dimensioned to be slightly smaller than the slots 30 and therefore it will be received in the slots 30 and also the larger slots 24. The tab 62 is utilized to stabilize the bracket 14 when it is engaged in the strip 10. With this tab 62 lateral movement of the strip securing portion 56 of the bracket 14 is limited and also unintentional upward movement of the strip securing portion 56 is prevented. By this arrangement then to remove the bracket 14 from the strip 10 the bracket arm 54 must be rotated upwardly to pivot about hook-shaped portion 58 and thus disengaged the tab 62 from the slots 30 and then remove the hook-shaped element 58 from engagement with the slots 24.

The slots 30 having a smaller dimension than the larger slots 24 are provided in the bottom portion 28 of the strip 10 so that in the case of a refrigerator for instance, the bracket 14 may not be placed below a particular desired location and assures that the bracket 14 will have both the hook shaped element 58 and the tab 62 engaged in slots of the strip 10.

The foregoing is a description of the preferred embodiment of the invention. In accordance with the Patent Statutes, changes may be made in the disclosed track assembly without actually departing from the true spirit and scope of the invention as defined in the appended claims.

What is claimed is:

1. A track assembly for securing to a wall and receiving shelves:

(a) two spaced, parallel, elongated strips having a plurality of slots along their lengths;

(b) an adaptor member located at one end of each of said strips, said adaptor member being U-shaped as viewed in cross-section along its longitudinal axis to provide depending legs connected by a body, the body having at least one circular hole therethrough and being dimensioned for each of the legs to be received through the slots in the strips such that the circular hole overlies one of the slots;

(c) an attachment element having a body through the circular hole of each of the adaptors and underlying strip slot into the wall and a headed portion larger than the circular hole abutting the adaptor member body to secure each of the strips to the wall; and (d) shelf brackets for each of the strips, said brackets having a hook-shaped attachment means at one end removably inserted in the slots for support of the bracket.

2. The track assembly of claim 1 wherein the adaptor member has two circular holes in the body and each hole overlies a separate slot in the strip.

3. The track assembly of claim 1 wherein the strips are U-shaped as viewed in lateral cross-section to provide two legs and a connecting middle portion with the slots in the middle portion.

4. The track assembly of claim 1 wherein the depending legs of the adaptor have detents to engage the ends of the slots in which each of the legs is inserted.

5. The track assembly of claim 1 wherein the shelf brackets are cantilevers.

6. The track assembly of claim 5 wherein the shelf brackets have a tab on the same end of the bracket as the hook-shaped attachment means and the tap is of a smalier dimension than the hook-shaped attachment means and is inserted in one of the slots to prevent vertical upward movement of the end of the bracket having the hook-shaped attachment means and tab.

7. The track assembly of claim 6 wherein the strips at the end opposite from the end having the adaptor members have at least one slot slightly larger than the tab of the bracket and smaller than the hook-shaped attachment means of the bracket.

8. The track assembly of claim 1 wherein the strips have a circular hole therethrough at the end opposite from the end having the adaptor members.

9. The track assembly of claim 1 wherein the attachment element is a screw.

10. A track assembly for securing to a wall and receiving shelves:

(a) two spaced, parallel, metal, U-shaped elongated strips as viewed in lateral cross-section having a plurality of slots along their lengths, one end of each strip having a circular hole therethrough and at least one slot smaller than the other slots;

(b) an adaptor member located at the end of each of said strips opposite the end having the circular hole, said adaptor member being U-shaped as viewed in cross-section along its longitudinal axis to provide depending legs connected by a body, the body having at least one circular hole therethrough and each of the legs being dimensioned to be received through the slots in the strips such that the circular hole overlies one of the slots;

(c) an attachment element having a body through the circular hole and underlying slot into the wall and a headed portion larger than the circular hole abutting the adaptor member body to secure each of the strips to the wall;

(d) shelf brackets for each of the strips, said brackets having a hook-shaped attachment means at one end removable inserted in only the large slots for support of the bracket and a tab on the same end of the bracket as the hook-shaped attachment means and dimensioned to be removably inserted in any one of the slots.

* * * * *